US008939089B2

(12) United States Patent
Hematian

(10) Patent No.: US 8,939,089 B2
(45) Date of Patent: Jan. 27, 2015

(54) FITTING FOR AUTORACK RAILROAD CAR HOUSING

(71) Applicant: National Steel Car Limited, Hamilton (CA)

(72) Inventor: Jamal Hematian, Burlington (CA)

(73) Assignee: National Steel Car Limited, Hamilton, Ontario (CA)

( * ) Notice: Subject to any disclaimer, the term of this patent is extended or adjusted under 35 U.S.C. 154(b) by 222 days.

(21) Appl. No.: 13/678,250

(22) Filed: Nov. 15, 2012

(65) Prior Publication Data

US 2014/0130706 A1 May 15, 2014

(51) Int. Cl.
*B61D 25/00* (2006.01)
*B61D 3/18* (2006.01)

(52) U.S. Cl.
CPC ..... *B61D 3/187* (2013.01)
USPC ..... 105/396; 105/404; 105/355

(58) Field of Classification Search
USPC ..... 105/396, 404, 401, 355; 410/87, 117, 410/118, 155
See application file for complete search history.

(56) References Cited

U.S. PATENT DOCUMENTS

| | | | | | |
|---|---|---|---|---|---|
| 4,437,410 | A | | 3/1984 | Stoller, Sr. et al. | |
| 4,646,652 | A | | 3/1987 | Burleson | |
| 4,913,061 | A | * | 4/1990 | Youngblood | 105/378 |
| 5,239,933 | A | * | 8/1993 | Murphy et al. | 105/374 |
| 5,415,108 | A | * | 5/1995 | Murphy et al. | 105/355 |
| 5,527,139 | A | * | 6/1996 | Bruder et al. | 410/117 |
| 5,579,697 | A | * | 12/1996 | Burke | 105/355 |
| 5,669,745 | A | * | 9/1997 | Anderson | 410/87 |
| 5,687,650 | A | * | 11/1997 | Murphy et al. | 105/355 |
| 5,701,825 | A | * | 12/1997 | Peach, Jr. | 105/355 |
| 5,743,192 | A | | 4/1998 | Saxton et al. | |
| 5,762,001 | A | * | 6/1998 | Dworakowski | 105/355 |
| 5,787,816 | A | * | 8/1998 | Dworakowski et al. | 105/404 |
| 6,003,445 | A | * | 12/1999 | Coslovi et al. | 105/355 |
| 6,289,822 | B1 | | 9/2001 | Black, Jr. et al. | |
| 6,553,917 | B1 | * | 4/2003 | Burke et al. | 105/355 |
| 6,561,740 | B1 | * | 5/2003 | Burke et al. | 410/87 |
| 6,805,523 | B2 | * | 10/2004 | Burke et al. | 410/87 |
| 6,843,062 | B2 | | 1/2005 | Crete | |
| 6,860,685 | B2 | * | 3/2005 | Thomson et al. | 410/87 |
| 7,802,525 | B2 | * | 9/2010 | Dawson et al. | 105/243 |
| 2002/0067970 | A1 | * | 6/2002 | Thomson et al. | 410/87 |
| 2002/0127078 | A1 | * | 9/2002 | Schorr et al. | 410/87 |
| 2012/0024188 | A1 | * | 2/2012 | Budnick | 105/1.4 |
| 2014/0116290 | A1 | * | 5/2014 | Hematian et al. | 105/404 |
| 2014/0130706 | A1 | * | 5/2014 | Hematian | 105/404 |
| 2014/0130707 | A1 | * | 5/2014 | Batchelor | 105/450 |

* cited by examiner

*Primary Examiner* — Jason C Smith
(74) *Attorney, Agent, or Firm* — Hahn Loeser & Parks LLP

(57) ABSTRACT

An autorack railroad car has a housing surmounting an underframe. The underframe defines a first or main deck. The housing, or "rack" defines at least one additional deck spaced upwardly from the main deck. The housing has end doors. The end doors may be folding end doors, such as a tri-fold hinged door. When closed, the door may be secured by latches at top and bottom. The car may have a dynamic response member, such as a damper, or stop, mounted between one or more panels of the door and the adjacent end of the deck. The dynamic response member may function either to provide damping to the door in vibration, or may function to define a vibration nodal point intermediate the main deck and the roof, or both.

19 Claims, 15 Drawing Sheets

FITTING FOR AUTORACK RAILROAD CAR HOUSING

FIELD OF THE INVENTION

The various inventive aspects and features herein relate to the field of railroad freight cars, of which one example is field of railroad freight cars for carrying automotive vehicles, this kind of car being referred to in the industry as an "autorack" car.

BACKGROUND

Modern autorack cars, which is to say autorack cars built since about 1975 for carrying automobiles, trucks or other vehicles in a multiple deck arrangement, have typically had the structure of a flat car underframe covered by a surface defining a main deck for supporting automotive vehicles. Most typically an upstanding elevated-deck supporting framework is mounted to the underframe. Since about 1975 the framework has usually been enclosed within, or used also to support a barn-like housing structure, which may be referred to as a closure system. Closure systems may include side screens, roof, and end closures, typically in the form of movable doors, the better to discourage thieves and vandals. This superstructure is typically referred to collectively as the "rack" of the autorack. Most typically the framework structure includes a series of vertical posts spaced along the sides of the car, with diagonal bracing or shear web panels between the posts, as may be, and one or two additional decks spaced upwardly from the main deck, and upon which respective second and third layers of automotive vehicles may be transported. That is, the rack may be a bi-level rack (i.e., a single elevated deck spaced upwardly above the main deck of the underframe) or a tri-level rack (two upper decks rather than one). The cars tend to be as tall as permitted under the applicable AAR plate clearance diagrams, for this car type, mainly Plate 'J' and Plate 'K', with maximum heights above Top of Rail or 19'-0" and 20'-3" respectively. The housing may tend to have gable ends and bridge plates that are movable to an extended position to span the gap between adjacent cars during loading and unloading. Those end closures, when open, permit circus loading of the cars, i.e., sequential loading of the automotive vehicles by driving in one end, and out the other on arrival. Although other kinds of end closures are known, most typically radial arm doors are mounted at the ends and are movable between open and closed positions to govern loading and unloading of the cars. The racks are typically replaced twice during the economic life of the autorack car underframe. That is, the old rack is removed from the underframe and replaced with a new set of racks.

Racks have doors. They may be folding doors, as shown and described herein. The folding doors may have two or more panels that are connected together in a hinged relationship permitting mutual angular deflection during door opening and closing. The panels of the door may tend to be rather long, and may tend to be prone to vibrate. One particular mode of vibration that may be observed is longitudinal vibration (i.e., the excursion is in the rolling direction of the car), at the lowest natural frequency of the panel.

It may be that the doors have access fittings, such as ladders or rungs defining ladders, mounted thereto for the purpose of permitting railroad personnel to ascend the various decks. It may also be that under certain operating conditions it may be desirable to have those access fittings in one configuration, such as a withdrawn, retracted, or stowed condition, while under other operating conditions it may be desirable for those fittings to be in a deployed or extended configuration.

SUMMARY OF THE INVENTION

Among the various inventive aspects and features herein, in an aspect of the invention there is an autorack railroad car for rolling motion in a longitudinal direction along railroad tracks. That autorack railroad car has a main deck; a first elevated deck spaced upwardly from the main deck; and a housing enclosing the main deck and the first elevated deck. The housing includes a roof spaced upwardly of the first elevated deck. The housing has an access-way at a first end thereof through which to conduct wheeled vehicles onto the main deck and the first elevated deck. The car has at least a door movable to govern access to the housing. The door is a folding door hingedly movable relative to the housing, the door having at least a first panel and a second panel hingedly connected together. The door has an upstanding first margin and an upstanding second edge margin. When the door is in a closed position the upstanding second edge margin is laterally inboard of the upstanding first margin. A dynamic response member is positioned height-wise intermediate the main deck and the roof, and laterally inboard of the upstanding first margin. In the closed position of the door the dynamic response member impedes primary mode vibration of the door in the longitudinal direction.

In a feature of that aspect of the invention the dynamic response member is positioned longitudinally between the first elevated deck and the door. In another feature, at least a first portion of the dynamic response member is mounted to the first elevated deck. In still another feature, a second portion of the dynamic response member is mounted to the door. In a further feature, the first and second portions of the dynamic response member interact. In still another feature, when the door is closed, the dynamic response member is longitudinally pre-loaded in the longitudinal direction. In a further feature, the dynamic response member comprises a damper.

In another feature, the dynamic response member defines a vibration nodal point intermediate the main deck and the roof. In still another feature, the dynamic response member is mounted between the first elevated deck and the door with a clearance in the range of 0" to ⅛", and with no longitudinal pre-load of the dynamic response member. In another feature, the dynamic response member has a first portion mounted to one of (a) the door, and (b) the first elevated deck; and a second portion mounted to the other of (a) the first elevated deck, and (b) the door; the first and second portions of the deck are mounted to work co-operably in opposition to each other; and the first portion includes a damping material and the second portion defines a seat positioned for engagement by the damping material.

In another feature, there is a second dynamic response member, the second dynamic response member being spaced height-wise from the first dynamic response member and intermediate the first dynamic response member and the roof. In a further additional feature, there is a second elevated deck spaced upwardly from the first elevated deck. The roof is spaced upwardly of the second elevated deck. The door has an upstanding first margin and an upstanding second edge margin. The first dynamic response member is mounted to work between the door and the first elevated deck. The second dynamic response member is mounted to work between the door and the second elevated deck. In a still further feature, the first and second dynamic response members include a damper.

In still another feature, the door is a first door, the car has a mating second door, and the first and second doors are co-operable to govern access to the first end of the housing. In another feature, the dynamic response member is positioned longitudinally between the first elevated deck and the door. At least a first portion of the dynamic response member is mounted to the first elevated deck. A second portion of the dynamic response member is mounted to the door. The first and second portions of the dynamic response member interact. One of the first and second portions includes a damper. When the door is closed, the first panel is laterally outboard of the second panel. The dynamic response member is mounted to the second panel. In a further feature, the dynamic response member defines a vibration nodal point intermediate the main deck and the roof.

In another aspect of the invention there is an autorack rail road car having a main deck; a first elevated deck spaced upwardly from the main deck; and a housing enclosing the main deck and the first elevated deck. The housing includes a roof spaced upwardly of the first elevated deck. The housing has an entryway at a first end thereof through which to conduct wheeled vehicles onto the main deck and the first elevated deck. There is a door movable to govern access to the housing. The door has an upstanding root margin and an upstanding free edge margin. When the door is in a closed position the upstanding free-edge margin is laterally inboard of the upstanding root margin. The door has an overall height, the overall height defining a span associated with a primary mode natural frequency of vibration. When the door is in the closed position the door engages the first elevated deck, the engagement sub-divides the span, whereby the door is inhibited from vibrating in the primary mode.

In a further aspect of the invention, there is an autorack rail road car having a main deck; a first elevated deck spaced upwardly from the main deck; a housing enclosing the main deck and the first elevated deck. The housing includes a roof spaced upwardly of the first elevated deck. The housing has an entryway at a first end thereof through which to conduct wheeled vehicles onto the main deck and the first elevated deck. The car has a door movable to govern access to the housing. The door has an upstanding distant margin. The door has a first nodal engagement adjacent to the main deck. The door has a second nodal engagement adjacent to the roof. When the door is closed, the distant margin of the door has a third nodal engagement with the first elevated deck heightwise intermediate the first and second nodal engagements.

These and other inventive aspects and features may be understood with reference to the description which follows, and with the aid of the illustrations.

BRIEF DESCRIPTION OF THE FIGURES

The description is accompanied by a set of illustrative Figures in which.

DETAILED DESCRIPTION

Figure 1A:
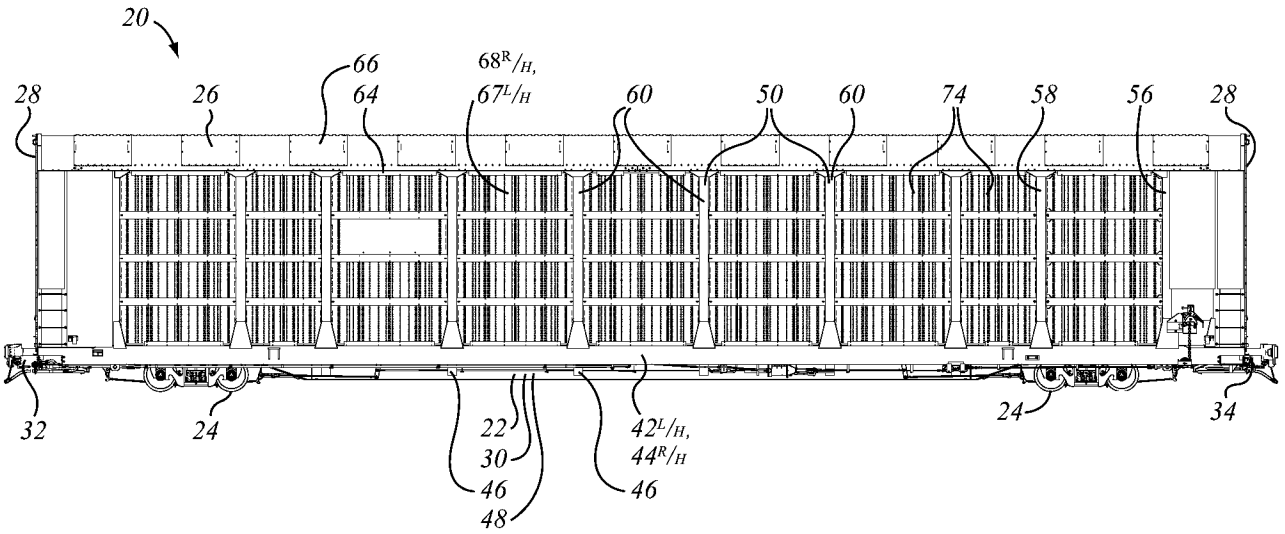
FIG. 1*a* is a general arrangement, side view of an autorack railroad car according to an aspect of the invention.
Figure 1B:
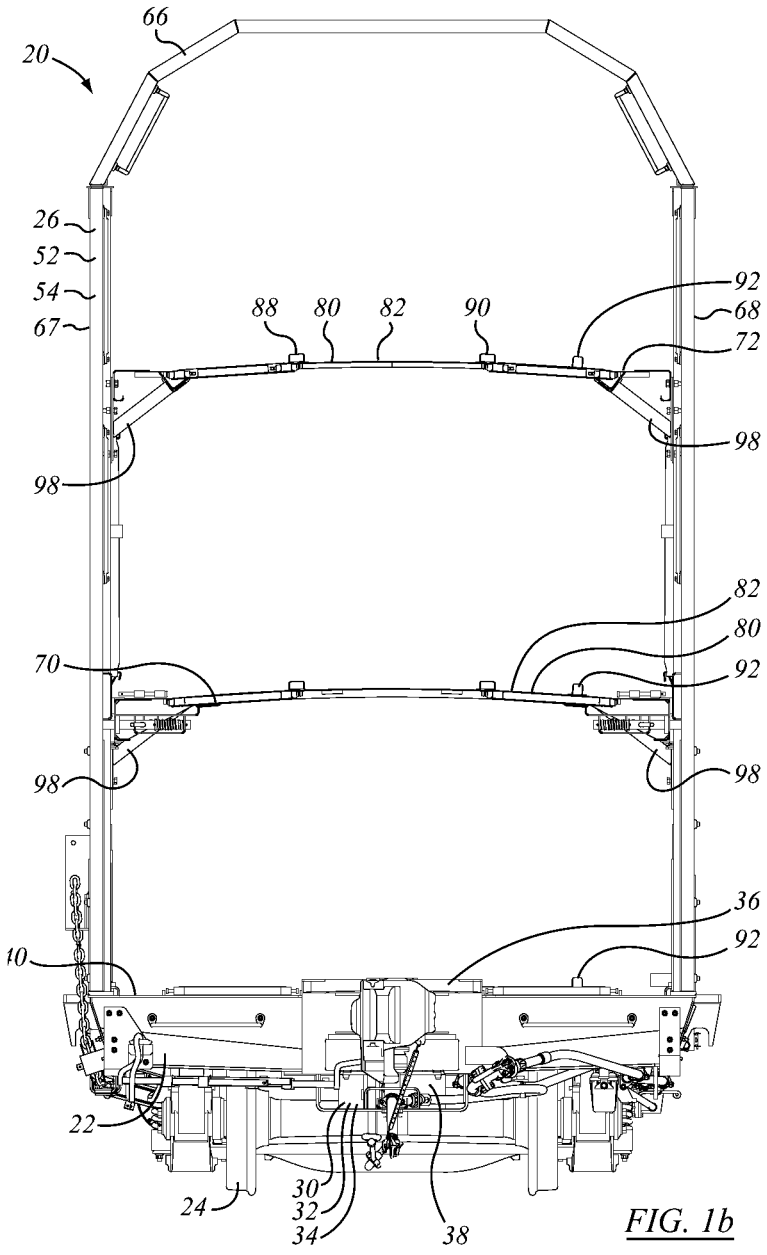
FIG. 1*b* is an end view of the autorack railroad car of FIG. 1*a;*
Figure 1C:
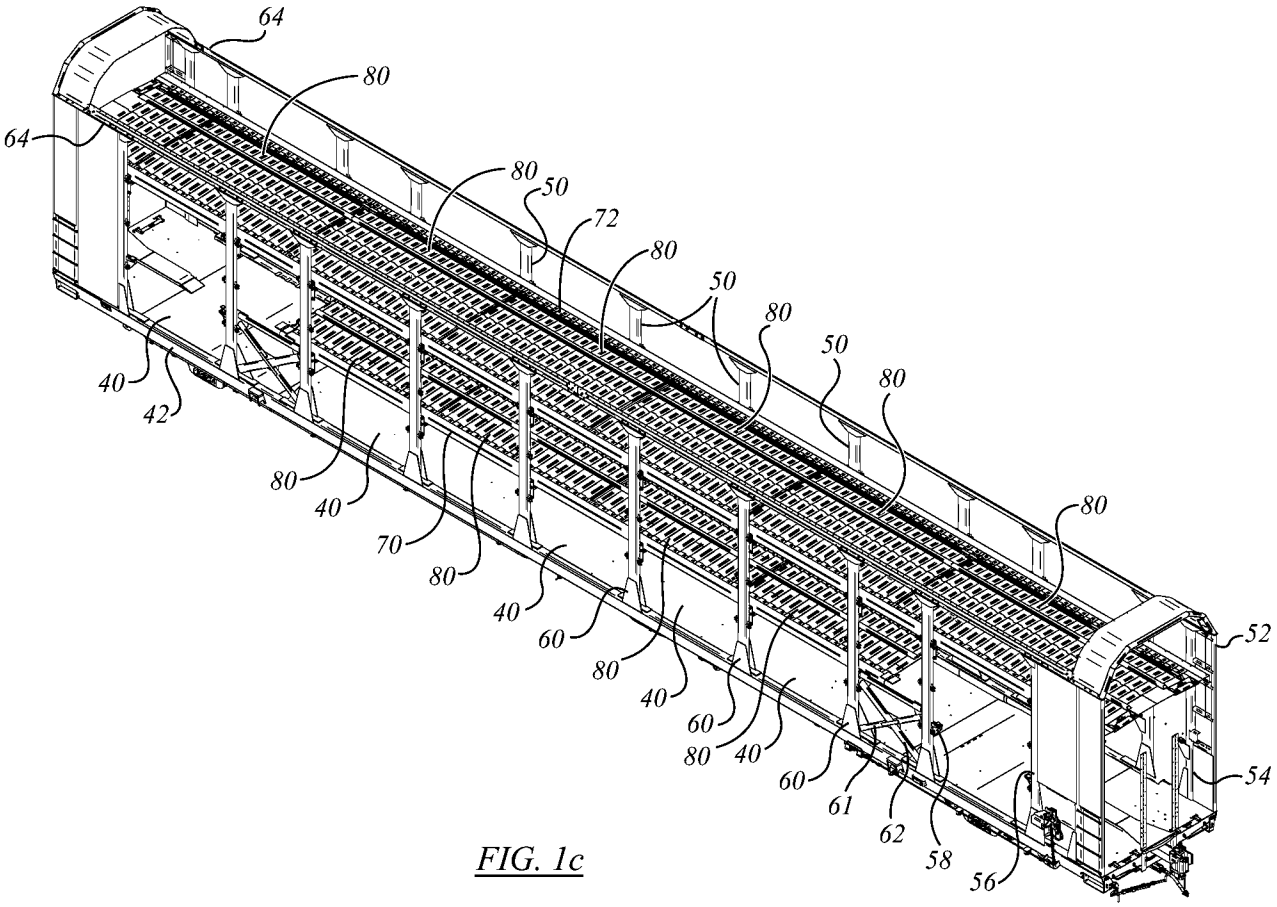
FIG. 1*c* is an isometric view of the autorack railroad freight car of FIG. 1*a* without trucks; with housing side panels and roof panels removed to show internal structure, and with the end portions of the mid-level deck removed.
Figure 1D:
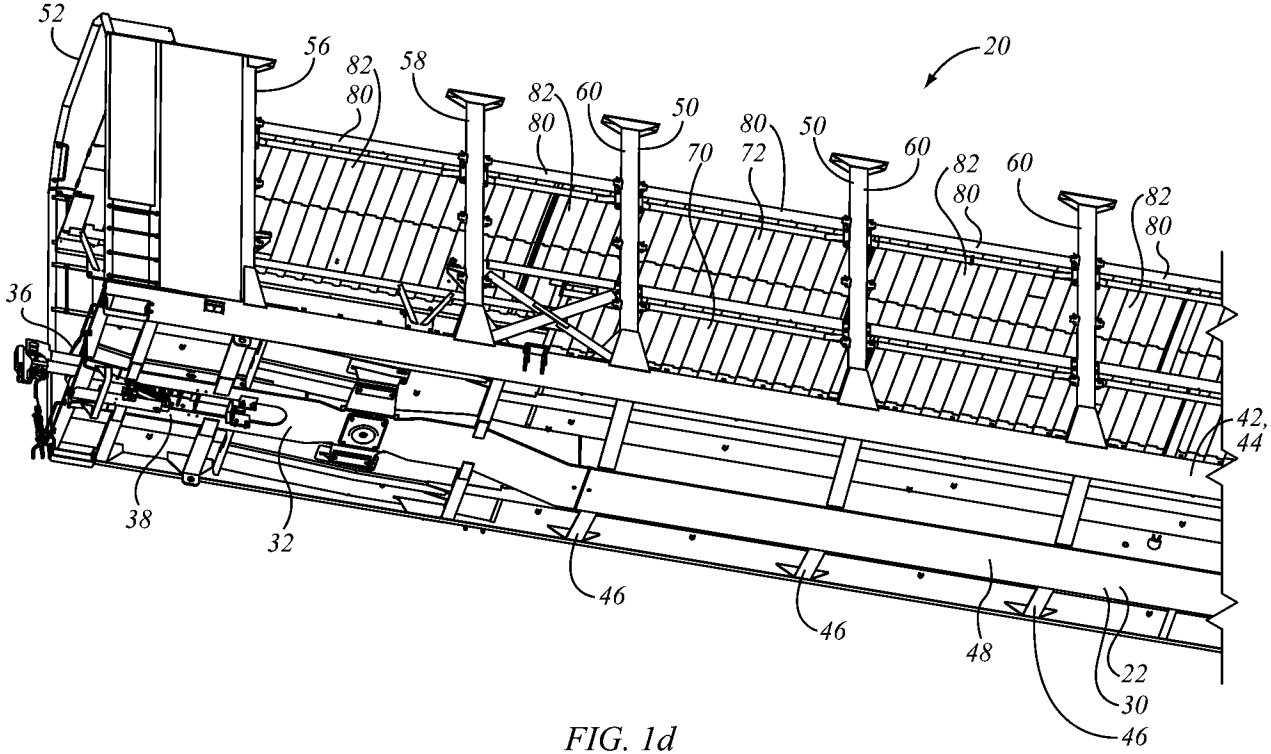
FIG. 1*d* is a perspective view, from below, of one half of the autorack railroad car structure of FIG. 1*c;*

The description that follows, and the embodiments described therein, are provided by way of illustration of an example, or examples, of particular embodiments of the principles, aspects or features of the present invention. These examples are provided for the purposes of explanation, and not of limitation, of those principles and of the invention. In the description, like parts are marked throughout the specification and the drawings with the same respective reference numerals. The drawings may be taken as being to scale unless noted otherwise.

The terminology used in this specification is thought to be consistent with the customary and ordinary meanings of those terms as they would be understood by a person of ordinary skill in the rail road industry in North America. The Applicant expressly excludes all interpretations that are inconsistent with this specification, and, in particular, expressly excludes any interpretation of the claims or the language used in this specification such as may be made in the USPTO, or in any other Patent Office, other than those interpretations for which express support can be demonstrated in this specification or in objective evidence of record, (for example, earlier publications by persons not employed by the USPTO or any other Patent Office), demonstrating how the terms are used and understood by persons of ordinary skill in the art, or by way of expert evidence of a person or persons of at least 10 years' experience in the rail road industry in North America or in other former territories of the British Empire and Commonwealth.

In terms of general orientation and directional nomenclature, for rail road cars described herein the longitudinal or lengthwise direction is defined as being coincident with the rolling direction of the rail road car, or rail road car unit, when located on tangent (that is, straight) track. In the case of a rail road car having a center sill, be it a stub sill or a straight-through center sill, the longitudinal direction is parallel to the center sill, and parallel to the top chords and side sills, as may be. Unless otherwise noted, vertical, or upward and downward, are terms that use top of rail, TOR, as a datum. In the context of the car as a whole, the terms cross-wise, lateral, or laterally outboard, or transverse, or transversely outboard refer to a distance or orientation relative to the longitudinal centerline of the railroad car, or car unit, or of the centerline of a centerplate at a truck center. The term "longitudinally inboard", or "longitudinally outboard" is a distance taken relative to a mid-span lateral section of the car, or car unit. The commonly used engineering terms "proud", "flush" and "shy" may be used herein to denote items that, respectively, protrude beyond an adjacent element, are level with an adjacent element, or do not extend as far as an adjacent element, the terms corresponding conceptually to the conditions of "greater than", "equal to" and "less than". The directions correspond generally to a Cartesian frame of reference in which the x-direction is longitudinal, the y-direction is lateral, and the z-direction is vertical. Pitching motion is angular motion of a railcar unit about a horizontal axis perpendicular to the longitudinal direction. Yawing is angular motion about a vertical axis. Roll is angular motion about the longitudinal axis. Given that the rail road car described herein may tend to have both longitudinal and transverse axes of symmetry, a description of one half of the car may generally also be intended to describe the other half as well, allowing for differences between right hand and left hand parts. In this description, if used, the abbreviation kpsi stands for thousands of pounds per square inch.

In this discussion it may by understood that persons of ordinary skill in the art are familiar with the Rules and Standards of the Association of American Railroads (the AAR), which govern interchange service in North America. This specification or the accompanying illustrations may refer to standards of the Association of American Railroads (AAR), such as to AAR plate sizes. To the extent necessary or appropriate, those references are to be interpreted in a manner consistent with the Rules and Standards as extant on the earliest of the date of filing of this application or the date of priority of the earliest application from which this application claims priority, as if they formed part of this specification on that date.

Also for the purposes of the present discussion, it may be taken as a default that the structure of the car is of all-welded mild steel fabrication except as otherwise shown in the illustrations or indicated in the text. This need not necessarily be the case. Other materials, such as aluminum or stainless steel might be used. The rack structure may also be taken as being of steel fabrication, although, again, aluminum or stainless steel might be used, and the side web panels of the car, which may be made of mild steel, stainless steel, or aluminum might also be made from plastic composite material, which may be reinforced composite. The commonly used engineering terms "proud", "flush" and "shy" may be used herein to denote items that, respectively, protrude beyond an adjacent element, are level with an adjacent element, or do not extend as far as an adjacent element, the terms corresponding conceptually to the conditions of "greater than", "equal to" and "less than".

In this description there is a discussion of doors. Autorcak cars are known to use at least three kinds of end doors to permit circus loading. The first kind of door is a tracked, multi-panel movable door such as shown in U.S. Pat. No. 4,437,410 of Stoller, which has a sequence of panels that roll generally laterally along a typically non-circular arc track. A second kind of door is the radial arm door, invented by Blunden, and shown in various forms in U.S. Pat. No. 3,995,563; and in a later version in U.S. Pat. No. 6,289,822 of Black et al. A third kind of door is the multi-folding door, typically either a bi-folding or tri-folding door, such as shown in U.S. Pat. No. 3,996,860 of Ravani, or in a later version, in U.S. Pat. No. 6,289,822 of Black, Jr., et al., or in U.S. Pat. No. 7,802,525 of Dawson et al. In the typical case, whichever kind of door may be used, the doors are mounted in left and right hand halves, and the pairs of doors are movable generally laterally outboard to an open position facilitating access to the interior of the autorack, and generally laterally inboard to a closed position impeding access to the car. Considering the closed position as the datum, the door, of whatever type, may have an upstanding outboard margin at, or near, the upstanding sidewall of the housing structure of the car, and an opposed upstanding inboard margin located generally at, or near, the longitudinal centerline plane of the car where it meets the corresponding inboard margin of the door on the other side of the car. In this description, the outboard upstanding edge may be termed the root edge, or the proximate edge or margin, or the staff edge or margin; the inboard margin may be termed the free edge or free margin, the distal edge or distal margin, or the distaff edge or distaff margin.

Also, in this description there may be discussion of modes of vibration. In general, an object may have a different natural frequency in vibration for each degree of freedom, be it translational or rotational, and there may be a plurality of modes of vibration for each degree of freedom. In each degree of freedom, the primary mode of vibration is typically the mode having the lowest natural frequency. Secondary, tertiary, and higher modes may correspond to higher frequency modes of vibration. Of all of the possible degrees of freedom of the part or assembly, the lowest natural frequency is typically the dominant resonant natural frequency of the structure, and, for the purposes of this discussion will be taken as the primary natural frequency mode of the structure.

In FIGS. 1*a*-1*d*, an autorack railroad car is shown generally as 20. It has an underframe, or underframe assembly, indicated generally as 22, that is carried upon railroad car trucks 24 for rolling motion in a longitudinal or lengthwise direction along railroad tracks. Underframe 22 is surmounted by an overspanning housing structure indicated generally as 26, and which may be referred to as "the rack" or "racks" of the car. The ends of housing structure 26 are open to permit loading and unloading of automotive vehicles. Ingress and egress of those vehicles is governed by a pair of end doors, 28, such as may be radial arm doors or multiply-folding movable between open and closed positions.

Underframe 22 has a center sill 30. Center sill 30 is a "straight through" center sill that runs substantially entire length of the car between first and second ends 32, 34 at which strikers 36 are mounted. The main deck 40 extends to either side of the center sill to the sides of the car at side sills 42, 44. The term "straight through" is used in distinction to stub center sills such as used in, e.g., grain cars, where the center sill at each end of the car is truncated inboard of the center plate to leave a "stub", namely the center plate and draft sill assembly. In a straight through center sill, the center sill extends from one truck center to the other. The outboard portions of the center sill may be identified as the draft sills 38 in which the draft gear and couplers are mounted. Draft sills 38 are extensions of center sill 30 that extend longitudinally outboard of (and often include) the truck center to the striker 36.

Side sills 42, 44 run lengthwise along either side of underframe assembly 22, and are structurally connected to center sill 30 by an array of laterally extending structural members 46 which may include cross-bearers 48 and cross-ties (not shown). A cross-bearer is a beam having a first end connected to the center sill at a connection that is intended to be capable of transmitting a bending moment, such that the cross-bearer is also a cantilever that has its root, or built-in end at the center sill. The second end or distal end or transversely outboard end of each cross-bearer is connected to the associated side sill running along that side of the car. The side sills are themselves beams, typically of hollow or open section, formed with an upper flange, a lower flange, and a medial portion that functions as a web to carry shear between the upper and lower flanges. Side sills may sometimes have a somewhat C-shaped section, with the open part of the C facing toward the center sill and the webs of the cross-bearer and cross-ties extending into the C and forming a connection.

Main deck 40 typically extends across the car from side sill to side sill and from end to end of the car, and provides a driving pathway for wheeled vehicles, i.e., the lading for this kind of car. Main deck 40 is supported by side sills 42, 44, center sill 30, cross-bearers 48 and such cross-ties as may be, and may form the top flange of one or more of them. In the example illustrated, for example, main deck 40 forms, or is substantially flush with the top cover plate (i.e., top flange) of center sill 30, over most or all of its length e.g., excluding draft sills 38. The main deck may also form the top flange of the cross-bearers 46 and cross-ties (if any). The main deck is open at the ends (i.e., the curbs defined by the side sills only run along the sides) such that wheeled vehicles may be end-loaded.

Looking at the framework of housing structure 26, housing structure 26 includes an array, or a series, of upstanding posts 50. That are spaced along the left and right hand sides of the car, i.e., along, and standing upwardly of, side sills 42 and 44 respectively. There is an end framing structure, indicated as 52, that extends upwardly from the ends of the end sill, and which defines the shape of the gable end. Next inboard is "the first post", an upright side post 54 that runs between the side sill and the top chord at the station of the first lateral cross-members. Next inboard are posts 56, mounted at the ends of the first lateral frame (i.e., outboard of the truck center), and posts 58, mounted near the ends of the second lateral frame member inboard of the truck center. Posts 60 are mounted further inboard at the ends of the respective cross-bearers 46 that extend laterally of central portion 48 of center sill 30. Diagonal shear bracing 61, 62 is mounted between main posts 58 and next longitudinally inboard posts 60. Longitudinally running left and right top chords 64 run along, and tie together, the tops of all of posts 54, 56, 58, and 60 as may be. The roof structure 66 is mounted atop top chords 64 and restrains them in the lateral direction, and provides a lateral shear connection between the left and right hand side walls 67, 68 of the car. The roof structure includes a framework of lateral frames and longitudinal stringers (not shown). This framework and the stringer form a truss structure that cooperates with the truss structure of the sidewall posts. The framework may support one or more elevated decks, such as a second or mid-level deck 70, and a third or upper deck 72. The entire structure includes sidewall panels 74 that are mounted between the various posts, and that may tend to act as shear panels between those posts and between the side sills 42, 44 and the respective top chords 64.

When the replaceable rack structure of posts and braces and top chords is in place, the high longitudinal members act as chords of a truss more than 10 ft. distant from the side sills. This deep truss structure provides the car with the resistance to vertical bending required when carrying lading in service. As noted above, the underframe is intended to define, and to be, permanent structure of the autorack car, whereas the racks may have roughly one third the life of the underframe. That is, the underframe may be provided with a first set of racks when new, and then with a further two sets of replacement racks during the car's lifetime.

Figure 2A:
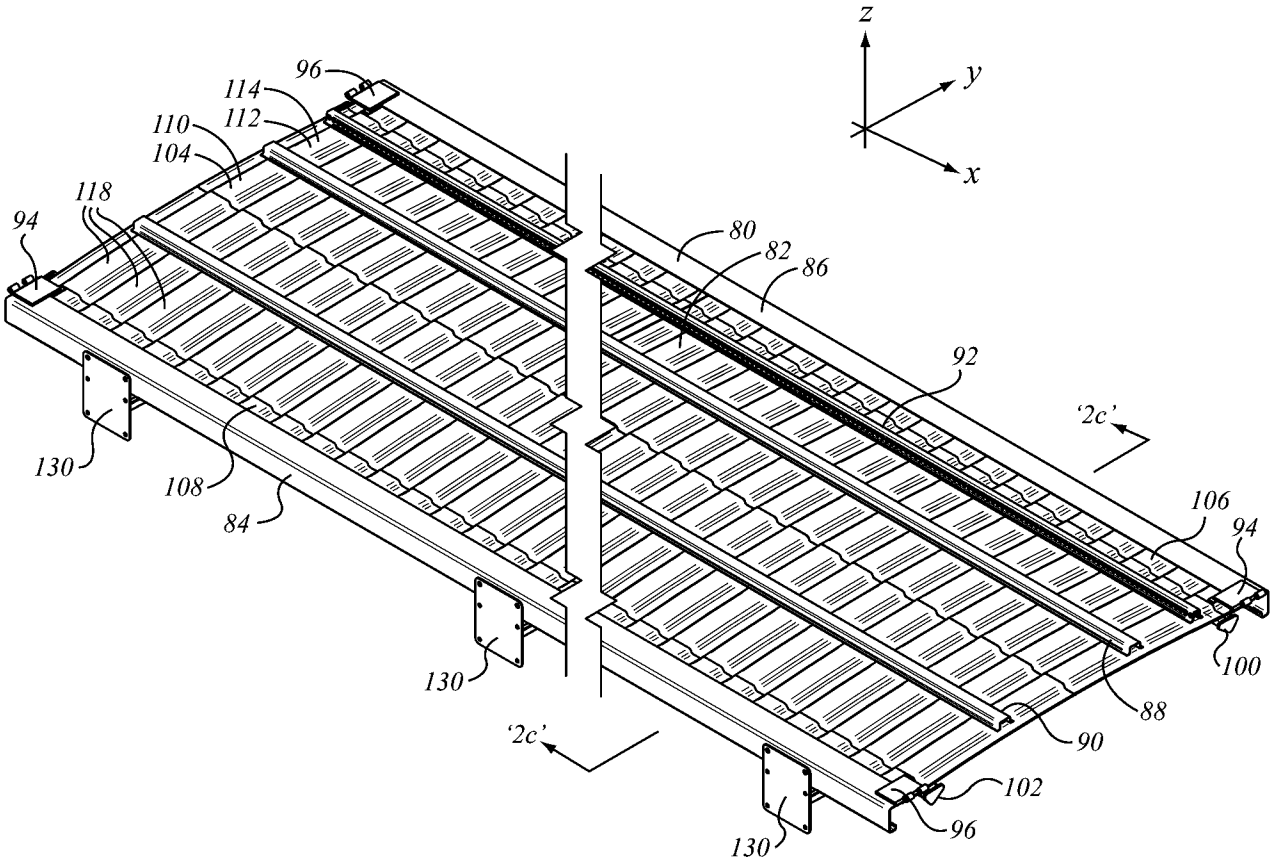
FIG. 2*a* is an isometric view of a section of deck for use in an autorack railroad car such as that of FIGS. 1*a*, 1*b*, 1*c* and 1*d;*
Figure 2B:
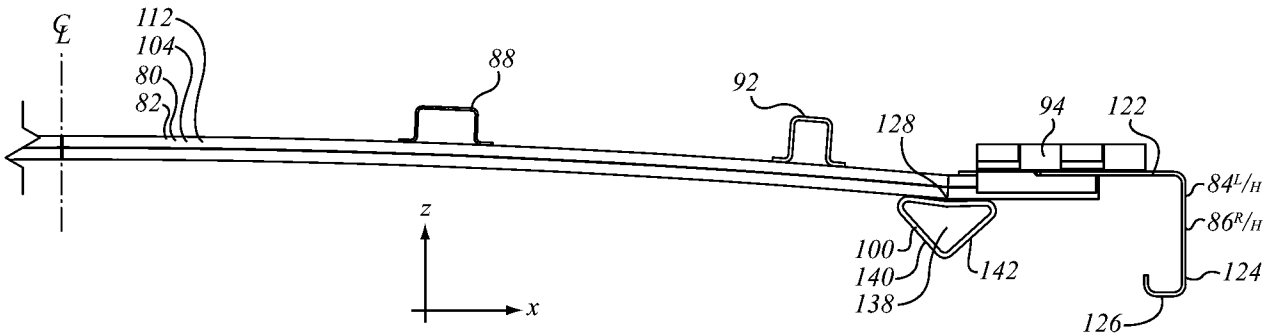
FIG. 2*b* is a half end view of one half of the section of deck of FIG. 2*a;*
Figure 2C:
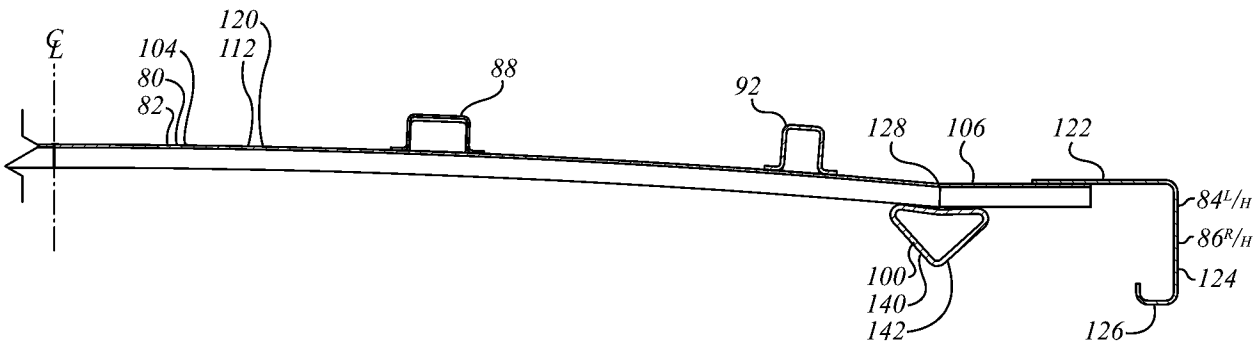
FIG. 2*c* is a half sectional view taken on section '2*c*-2*c*' of the deck of FIG. 2*a;*
Figure 2D:
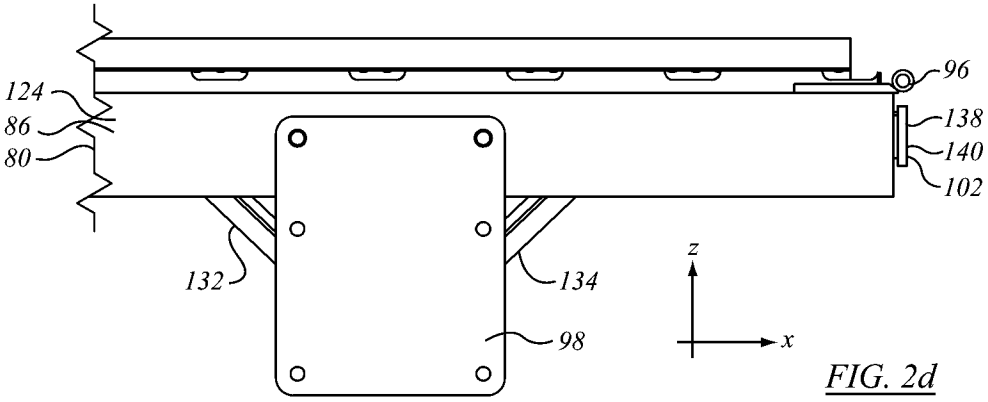
FIG. 2*d* is a side view showing a detail of the deck assembly of FIG. 2*a;*
Figure 2E:
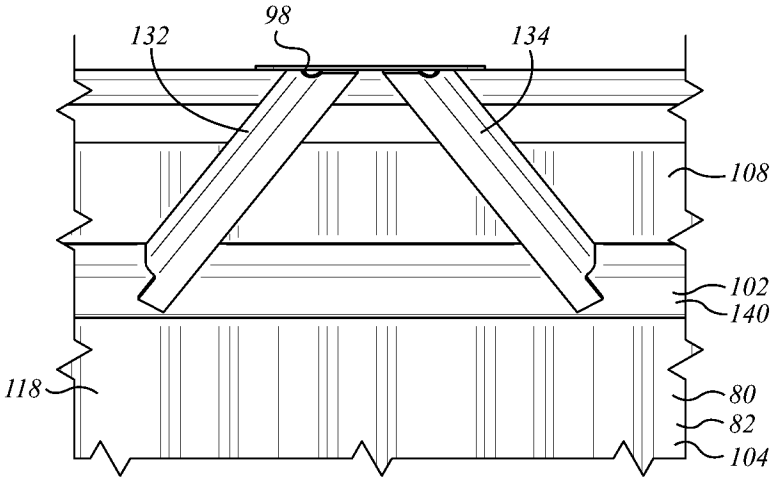
FIG. 2*e* is an upwardly looking view of the detail of FIG. 2*d;*

The rack structure of the elevated deck or decks includes a set of deck panels, or deck panel assemblies, of which a representative one is shown in FIG. 2*a* as deck panel assembly 80. Other than as noted, assembly 80 is symmetrical about the longitudinal vertical (i.e., x-z) centerline plane of the rack, and spans the open space between the left and right hand sidewall support structure of car 20. It may also be noted that deck panel assembly 80 may be manufactured in different lengths, and a set of deck panels 80 is installed to define a full length deck of car 20, be it deck 70 or deck 72. As may be appreciated, each of deck panels 80 may be replaced as an individual module if damaged or corroded, or in need of replacement or repair for whatever reason. Deck panel assembly 80 includes a main, or first, decking panel 82, first and second, (or left and right) side beams or rails 84, 86, first and second, or left and right, upper longitudinally running members 88, 90; a vehicle placement securement fitting, or fitting array 92, hinge fittings 94, 96, and first and second, or left and right hand, longitudinally extending underside stringers 100, 102.

Main decking panel 82 may include a central portion 104 and left and right hand edge or margin portions 106, 108. Main decking panel 82 may have an upper surface 112 which defines a roadway, or pathway, or track 114 over which wheeled vehicles may be conducted in the lengthwise direction (or x-direction) in the normal procedure of loading and unloading vehicles in autorack cars. Main decking panel 82 may also have an underside, or downwardly facing surface that faces toward the next lower deck, be it the middle deck (in the case of an upper decking panel) or the rail road car main deck 40 of underframe 22. As installed, main decking panel is spaced upwardly from the next lower deck by a distance commensurate with the carrying of another layer of vehicles on the deck therebelow. Main decking panel 82 may have an undulating form, with up-and-down undulations in the vertical direction made to increase its effective depth of section and therefore its second moment of area for resistance to bending. The undulations may run cross-wise, namely in the lateral, transverse, left-to-right, or y-direction. The undulations run in the direction generally cross-wise to the lengthwise running direction of main decking panel 82 generally, and also of pathway 114. The undulations may have the form of corrugations 118.

Central portion 104 may be formed as a single section, or may be formed by welding two left and right halves together. In that context, the left and right halves may be identical, but reversed and welded together along a central seam. Central portion 104 may be formed on a curvature such that it has an arcuate crown 120, of which the crest is at, and runs along, the longitudinally running centerline. The downwardly and outwardly sloped margins or edges of central portion 104 meet, and are joined to, left and right hand margin portions 106, 108. The junction of these components may be formed by welding. Margin portions 106 and 108 are oriented horizontally. That is, if decking panel 82 is placed on a flat surface, margin portions 106 and 108 will lie in a common horizontal plane, which central portion 104 deviates convexly arcuately away from that plane.

Side beams, or rails, 84, 86 run in the lengthwise direction along margin portions 106, 108. Each side beam 84, 86 has a first leg 122 that extends substantially horizontally, a second leg 124 that extends substantially vertically, and a roll-formed lower flange 126 which is located distant from first leg 122. In this way first leg 122 functions as an upper flange, and second leg 124 functions as a vertical shear web. The distal portion of first leg 122 that is most distant from second leg 124 overlaps, and is welded to, a respective one of margin portion 106 or 108. The corrugations of margins 106, 108 extend downwardly of first leg 122. The ends of portions 106, 108 terminate inboard well clear of second leg 124, and are offset laterally inboard relative to flange 126, such that a water drip falling straight down from an open corrugation end would drop clear of flange 126.

Longitudinally running members 88 and 90 are mounted to the upwardly facing surfaces of the corrugations, symmetrically to either side of the centerline of crown 120. Members 88 and 90 may have the form of open structural section members, and in one form may be inverted channels or top-hat sections with the toes of the legs mated to surfaces 112 of the successive corrugations. Members 88 and 90 may function as upper, longitudinal flanges of deck panel assembly 80. They may also function as upstanding guideways, or curbs, for wheeled vehicles being conducted along deck panel assembly 80. To the extent that the open section faces downward, and is self-draining, it is not a place where moisture, dirt, or other material may tend to collect.

Securement fitting 92 may have the form of a locking rail spaced laterally outboard from member 90. Securement fittings may be placed on both sides of the centerline of deck panel assembly 80, however, in the embodiment shown only a single securement fitting rail is shown, it being a non-symmetrical feature of an otherwise symmetrical assembly. The apertures formed in the inboard upstanding leg of securement fitting 92 provide engagement points for wheel lock-down apparatus, or chocks, used to prevent motion of wheeled vehicle lading during operation of railcar 20.

Hinge fittings 94 and 96 may mate with corresponding hinge fitting of adjacently placed movable decks or bridge plates, as may be. Mounting bracket assemblies 98 define the mounting interfaces at which deck panel assembly 80 is connected to the side post array, and thus suspending in an overhead spanning position relative to any lower deck or decks.

Underside stringers 100 and 102 may be mounted to the underside, or downwardly facing surface of the successive corrugations of main decking panel 82. They may be placed laterally outboard of respective upper longitudinally running members 88, 90. They may be placed laterally closer to side beams 84, 86 than to members 88, 90. Each may be placed adjacent to a respective slope discontinuity 128 at the junction of central portion 104 and each of side portions 106 and 108. Underside stringers 100, 102 may each be placed to overlap slope discontinuity 128, thereby to provide reinforcement at what might otherwise be a location of weakness in the panel.

Mounting bracket assemblies 98 may include fittings such as mounting plates 130, which may be substantially rectangular and which may define a mounting foot of deck panel assembly 80. They may have pre-bored holes that locate on the upright posts, as may be. Diagonal reinforcement, or braces, or load spreading members 132, 134 may be positioned with one end rooted to plate 130, and a distant end attached to main decking panel 82 or to one of underside stringers 100, 102.

In the past, stringers for autorack decks have been made with an L-shaped piece of steel, and angle iron, installed with its toes upward, mounted to the underside of the deck sheet. When thus mounted, the stringer forms a trough that may be liable to collect dirt and debris, particularly during the shot blast process prior to painting where the trough may tend to function as a shot trap. When debris or other material of this nature remains in the trough, it subsequently may be a rust initiation site, and may cause or hasten premature rusting of the rack. Further, where rusting occurs, and there is moisture in the car, whether from collection of rain or snow, dripping of automobiles when loaded, or from condensation overnight, the rusty water may drip on the automobiles carried as lading within the autorack, thus potentially ruining their finish. Shot that collects from the blast process, as well as dust, dirt and debris from ordinary usage, should be removed. It is a painstaking task. The process may be difficult due to either lack of access or poor access. It is generally desirable to need to spend less time cleaning after blast, and to deliver a cleaner product. By replacing the L-shaped stringer with a closed section, the trough is covered. A closed stringer prevents shot, dust, and dirt from being collected, greatly simplifying cleaning This may tend to discourage or prevent the collection of debris therein. This in turn may reduce or eliminate the need for cleaning, and may reduce or delay the onset of rusting of the stringer. Having a closed stringer may tend to prevent it from trapping dirt, and hence to reduce the need for regular cleaning, or to allow longer intervals between cleaning. Having a cleaner autorack may tend to allow them to deliver automobiles with less dirtying and damage.

Several embodiments of a closed stringer are shown and described herein. This includes typical L-channels with closure plates welded either on top or inside; a roll-formed profile with continuously welded seam; and standard hollow structural sections.

Figure 3A:
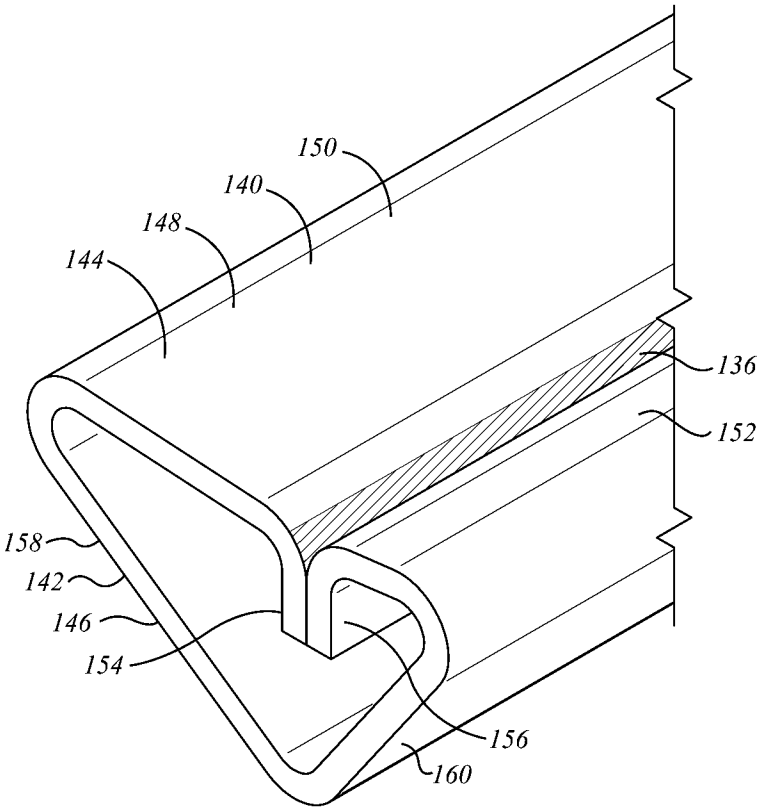
FIG. 3*a* is an isometric view of a stringer of the deck assembly of FIG. 2*a;*

In FIG. 3*a* a stringer, be it 100 or 102, is shown as 140. Stringer 140 runs the length of deck panel assembly 80. As may be noted stringer 140 has an external wall section 142 that defines a periphery, that is, when oriented as installed, closed at the top side as at 144, such that water may not tend to collect in stringer 140, and such that blast shot may also tend not to collect. The periphery may be closed all-around such that the section is a closed hollow structural section. The external wall 142 includes not only the top side or part or portion, but another portion 146 that forms the remainder or balance of the closed section. Further aiding in closing the section, stringer 140 may be closed at its ends, as, for example, by end caps 138 such as may be welded or otherwise fixed in place.

Figure 3B:
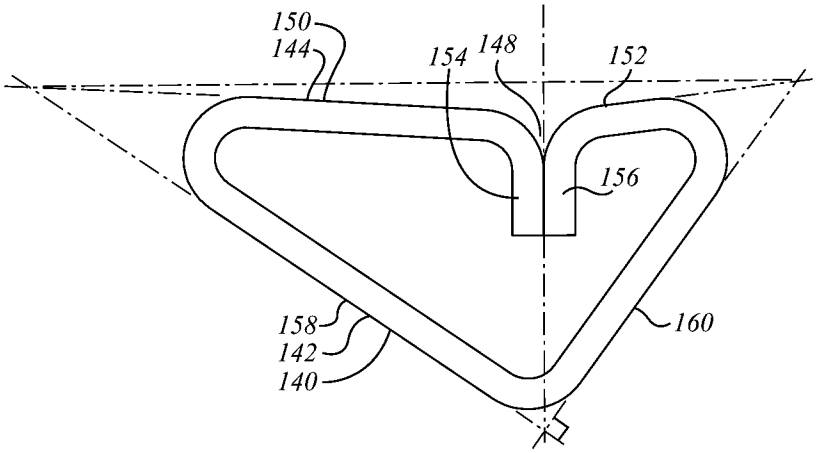
FIG. 3*b* shows an end view of the stringer of FIG. 3*a;*

The closed section may have a multitude of different possible forms. It may be substantially circular, or square, or rectangular, or D-shaped. In the examples shown it may be substantially three-sided or triangular. The sides or parts, or portions need not be planar, i.e., linear as viewed in section. However many sides there are, and whether those sides be straight or not, the upper part may provide a surface, or seat, such as at 148 for mating engagement with the underside of main decking panel 82. In the embodiment illustrated in FIGS. 3*a* and 3*b*, top side 144 has a kinked or dog-legged, or gull-winged, or reflex angle shape, there being first and second parts 150 and 152 of top side 144, parts 150 and 152 meeting at an internal angle that exceeds 180 degrees, the angle and shape being suited to seat next to, to accommodate, or to conform to, the slope change, or slope discontinuity, at the transition or junction between central portion 110 and one or the other of margin portions 106, 108 of main decking panel 82. Top side 144 need not be horizontal, but may be on a slant, such that it may not be the "top" of stringer 144, but may be the uppermost side thereof. In the example of FIGS. 3*a* and 3*b*, parts 150 and 152 may be substantially planar. The end portions, or legs 154, 156 of parts 150 and 152 may be roll formed such that they curl inwardly next adjacent to each other. Where the radii of the back of legs 154, 156 come together, a fillet weld is formed along stringer 140 as indicated at 136. The fillet weld may lie shy of (i.e., below), or flush with the planes of parts 150 and 152 so as not to impede mounting of stringer 140 next to the transition of main decking panel 82. As can be seen, in this embodiment top side 144 overlaps the slope change discontinuity in main decking panel 82. In this embodiment, in which stringer 140 is substantially triangular in section, top side 144 may be the long side, and the other two sides are identified as second side 158 and third side 160. Second and third sides 158 and 160 may meet at a right-angled corner. Any or all of the vertices of the section may be radiused, as indicated.

In other embodiments, top side 144 need not be kinked or dog-legged, but may be straight as viewed in section (such that top side 144 is planar), or may follow an arc such as may correspond to main decking member 82 and the slope change therein. Further, stringer 140 need not be placed at, or overlap the slope change discontinuity in main decking panel 82, or at the junction of the margins of portion 104 with 106 or 108 as may be. Stringer 140 could be placed to either side of that junction, either undergirding portion 104 or either of portions 106 and 108.

FIGS. 4*a*, 4*b*, 5*a*, 5*b*, 5*c*, 6*a*, 6*b*, 6*c* and 6*d* all show views of the end doors of autorack railroad car 20. In the embodiment shown doors 28 include a left hand door 200 and a right hand door 202. In this embodiment, each of doors 200 and 202 is a folding door, and, in this example, a multiply folding door. Doors 200 and 202 are substantially the same in terms of their major structural components, and differ only to the extent of secondary fittings, such as door latching hardware and so on. To that extent, a description of the structure of one door may be taken as a description of the structure of the other door, allowing for left and right handedness.

As illustrated, door 200 (or 202 as may be) may be a triple folding, or tri-fold, door. With terminology based upon door 200 being in the closed position of FIG. 4*a*, commencing at the laterally outboard secured hinged edge 204 at which door 200 mates hingedly with sidewall 68, door 200 may include a first, or staff or outside or laterally outboard, member or wing or panel, 206, a second, or intermediate, or middle, member or wing, or panel 208, and a third, or laterally inboard, or distal, or distaff, wing, or member or panel 210. As may be understood, first panel 206 is hingedly connected to sidewall 68 at hinges 212, as noted, with hinges 212 permitting rotation of panel 206 in the clockwise direction as seen from above; second panel 208 is hingedly connected to first panel 206 at hinges 214, which may have the form of upper and lower piano hinges as illustrated. Hinges 214 permit pivotal rotation of second panel 208 in a clockwise direction relative to first panel 206; and third panel 210 is hingedly connected to second panel 208 at hinges 216, hinges 216 permitting counter-clockwise pivotal motion of third panel 210 relative to second panel 208. Thus, in the fully open position shown in FIG. 4*b*, first panel 206 has been rotated outboard from the 12 o'clock position to the eight o'clock position, second panel 208 has been rotated such that its vertex at hinge 214 is adjacent the side sill, and third panel 210 is folded back the other way to lie against second panel 208, with its free edge laterally outboard.

Figure 4B:
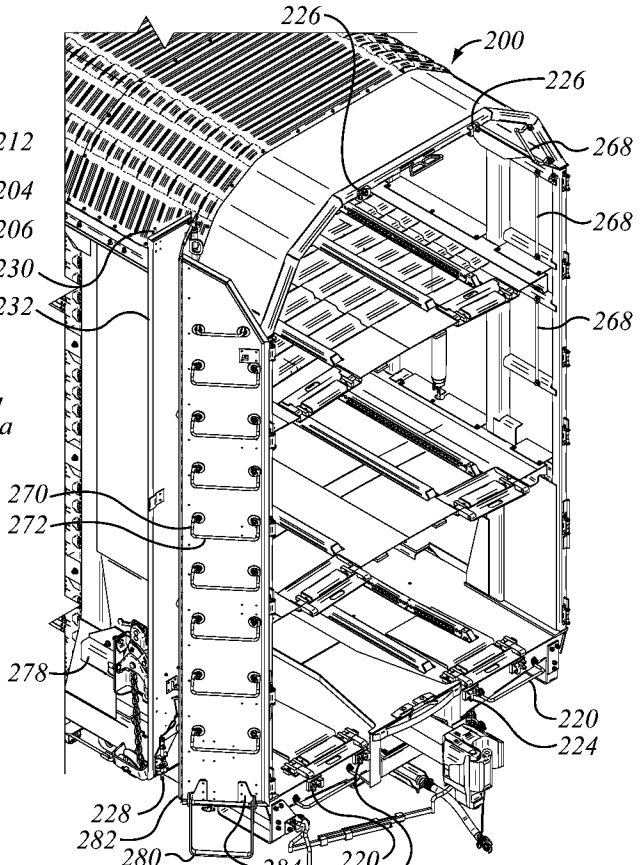
FIG. 4*b* shows an isometric view of the end portion of the autorack railroad car of FIG. 4*a* with its left door in the open position and right door removed.
Figure 4A:
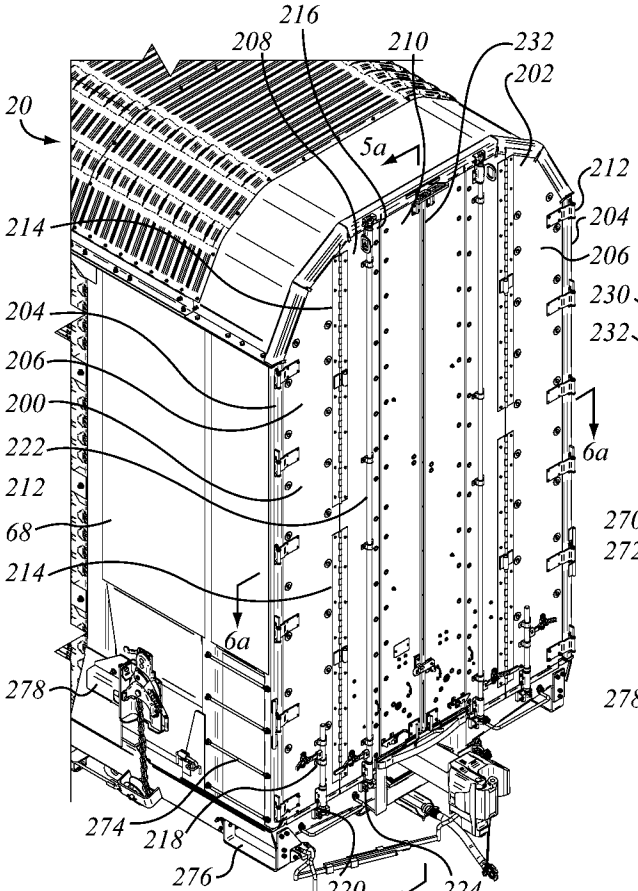
FIG. 4*a* shows an isometric view of an end portion of the autorack railroad car of FIG. 1*a* with its doors in the closed position.
Figure 5B:
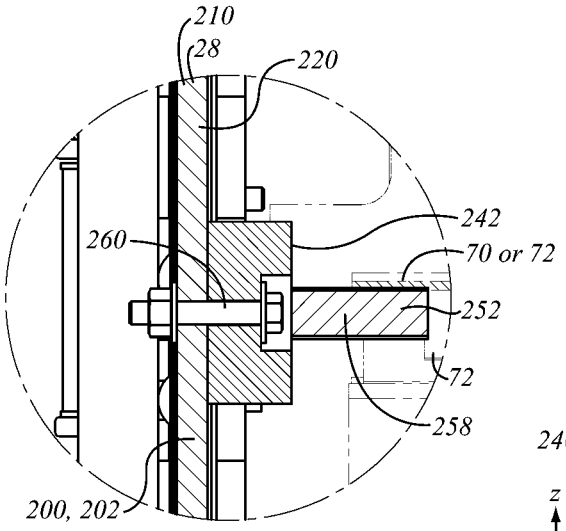
FIG. 5*b* is an enlarged view of a detail of the view of FIG. 5*a* showing a vibration damper installation at the level of an upper elevated deck.
Figure 5C:
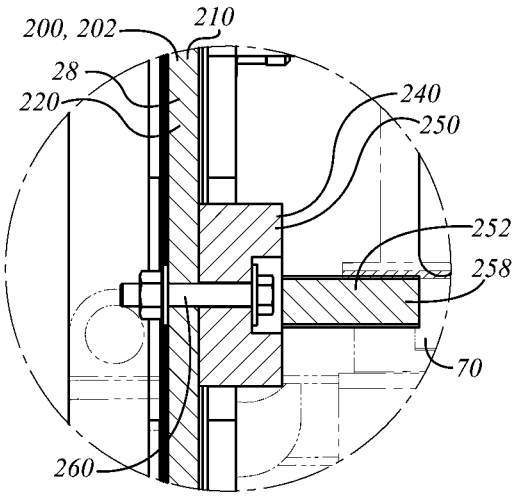
FIG. 5*c* is an enlarged view of a detail of the view of FIG. 5*a* showing a vibration damper installation at the level of a mid-level upper deck.
Figure 5A:
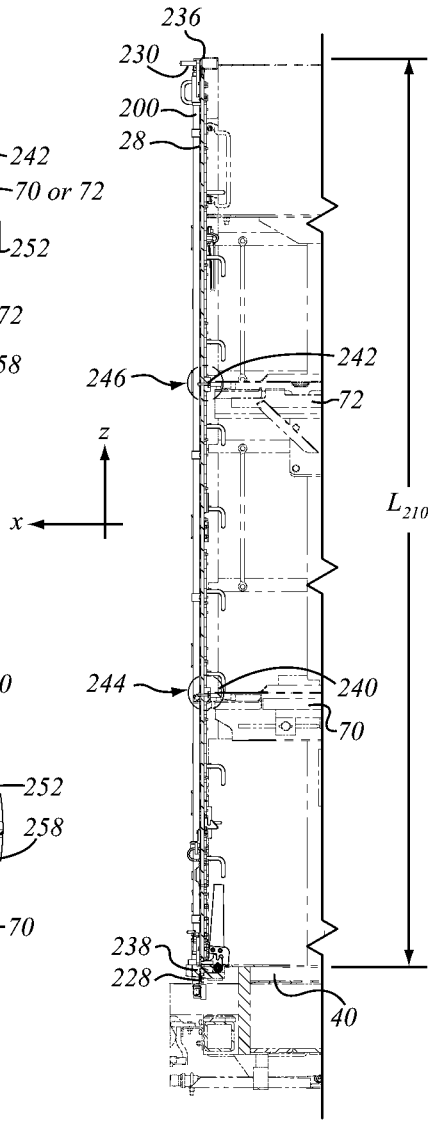
FIG. 5*a* is a view taken on a vertical section '5*a*-5*a*' of an end door of the autorack rail road car of FIG. 4*a;*
Figure 6A:
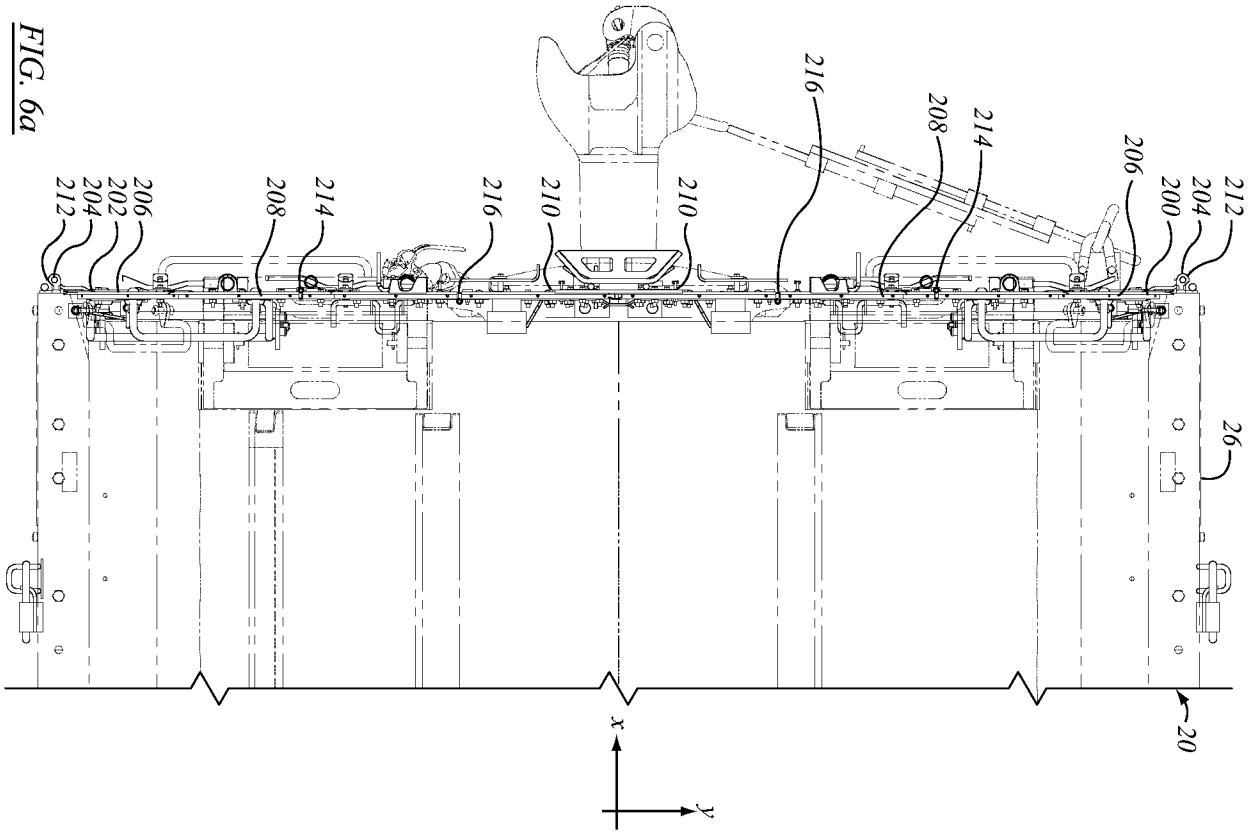
FIG. 6*a* is a sectional view taken on a vertical section taken on section '6*a*-6*a*' of an end door of the autorack rail road car of FIG. 4*a;*
Figure 6B:
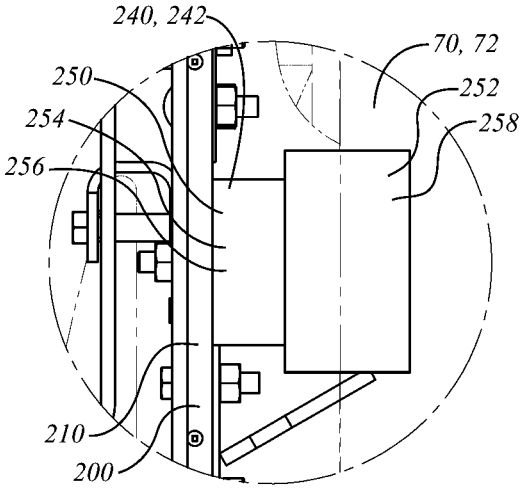
FIG. 6*b* is an enlarged view of a detail of the view of FIG. 6*a* showing a vibration damper installation at the level of an upper elevated deck.
Figure 6D:
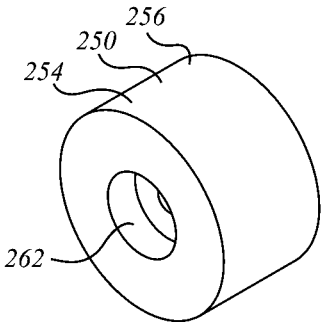
FIG. 6*d* is an isometric view of a bumper pad element for use in the autorack railroad car of FIG. 4*a;*
Figure 6C:
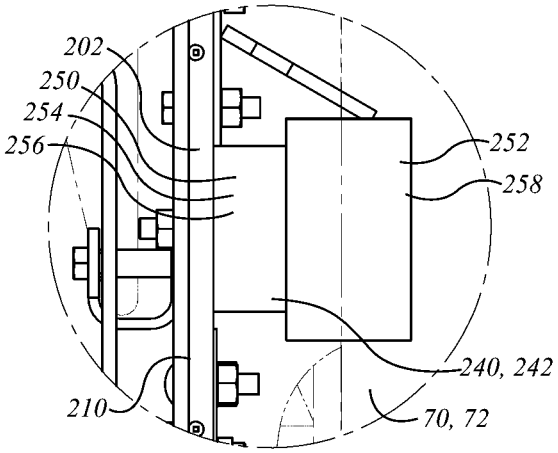
FIG. 6*c* is an enlarged view of a detail of the view of FIG. 6*a* showing a vibration damper installation at the level of a mid-level upper deck.

The door height may be relatively great, being of the order of up to 16 ft 9 in from the main deck level to the top center of the gable, and up to about 12½ ft at the top chord. The width of a full door may be a maximum of 64 inches in total for three panels to fit within the 128 inch AAR maximum allowable clearance width, the width of the widest panel of a tri-fold door being up to about 30 inches wide. Further, when a bi-fold or tri-fold door is closed, the door may tend to stand in a y-z plane, being generally flat. This may be compared to a radial arm door in which the section of the door has the depth of the corresponding arc, and therefore stiffness corresponding to the depth of section. The widths of panels 206, 208 and 210 may be unequal. For example, panel 206 may be of sufficient width to have a ladder, or ladder rungs, 270 mounted thereon. Panel 206 may be in the range of ⅓ to ½ of the width of door 200. Panel 210 may be wider than panel 208. For example, in one embodiment panel 206 may be 22-24 inches wide, and each of panels 208 and 210 may be about 15-16 inches wide. When unfolded and pivoted around, panels 206, 208 and 210 lie substantially in-line in a plane (a y-z plane in this example) across the end of the car as shown in FIG. 4*a*. In this view, an outboard releasable securement fitting, or latch, 218 is mounted to outboard panel 206, and, in the closed position engages mating fittings, shown as dogs 220 at deck level. Dogs 220 may be mounted to the face of the end sill. A releasable latch 222 may be mounted to middle panel 208, to mate with lower and upper fittings 224, 226 at the main deck and gable roof levels respectively. Lower and upper latches 228 and 230 may be mounted to panel 210 near free edge 232 of panel 210 (and door 200 more generally) in door 200 (or 202), by which to engage the lower and upper ends of panel 210 to the main deck and to the gable end, respectively.

Tri-fold doors on the ends of autoracks are typically quite large in spanning dimensions in the plane of the door (in the z and y directions, as closed), and thin in through-thickness (i.e., in the x-direction, as closed) with low stiffness in out-of-plane bending deflection. As can be seen, each door panel is relatively tall and quite narrow, with an aspect ratio of height to width of the order of 7:1 to 8:1 for the outside panel 206 and roughly 10:1 to 12:1 for third panel 210. Each panel has a skin or web, or sheet 220, and may have vertical reinforcements, or ribs, or stiffeners, and horizontal stiffeners.

For the panels of door 200 the large vertical length may tend to contribute to vibration issues. Door 200 may have a maximum vertical height or span from its lower edge 236 at, or adjacent to, main deck 40 to its upper edge 238 at the gable end of roof structure 66, that height being designated as $L_{210}$ for panel 210. When doors 200, 202 are closed, motion of upper and lower edges 236, 238 may be constrained by the various latches 212, 214, 216. That is, the latches restrain displacement of the edges of the door in the x and y directions, but do not transmit a bending moment. The door panels, and the door assembly as a whole susceptible to vibration, and, in particular, to vibration in the mode in which the pin securements at the main deck and the pin securements at the gable roof tend to define nodal points of zero deflection at which x-direction displacement may be considered to be nil.

It may be helpful to provide one or more elements that have the effect of either (a) defining vibration nodes intermediate the end nodes defined at roof structure 66 and at main deck 40, such as may tend to correspond to higher mode vibration (and therefore higher natural frequency) and to inhibit lower mode vibration inconsistent with the location of the vibration nodes; or (b) tending to dampen vibration motion, whether that motion is motion in the lowest natural frequency mode or otherwise.

For either or both of those purposes, car 20 may include dynamic response members 240 and 242. In some embodiments dynamic response members 240 and 242 may be referred to as bumpers or dampers. Dynamic response member 240 may be associated with a first nodal point location 244 relative to the vertical span of door 200 (or 202), and, in particular, of one panel thereof, such as distal panel 210. In a bi-level car, for example, first nodal point location 244 may be located at a height, $h_{244}$ corresponding to the height of first elevated deck 70. First nodal point location 244 is intermediate the nodal points defined at the interfaces with the main deck and roof respectively. In a bi-level car that height may be taken as being in the range of ⅖ to ⅗ of $L_{210}$, and typically may be about half of $L_{210}$. In a tri-level car $h_{244}$ may be in the range of 3/10 to ⅖ of $L_{210}$, and may typically be about ⅓ of $L_{210}$. A tri-level car may have not only a first nodal point location 244, but also a second nodal point location 246. Second nodal point location 246 is also intermediate the deck and roof interfaces. Dynamic response member 242 may be associated with a second nodal point location 246 relative to the vertical span of door 200 (or 202), and, in particular, of panel 210 thereof. Second nodal point location 246 may be located at a height $h_{246}$, which may correspond to the height of second elevated deck 72. In a tri-level car $h_{246}$ may be in the range of ⅗ to 7/10 of $L_{210}$, and may typically be about ⅔ of $L_{210}$.

Either of dynamic response members 240 or 242 may be a single, monolithic member mounted to door 200 (or 202), or to the end of deck 70 (or deck 72, as may be). Either or both of members 240 and 242 may be referred to as a bumper or as a damper. Alternatively, either or both of dynamic response members 240 and 242 may include a first member 250 and a second member 252. First member 250 may be, or may include, a bumper pad or damper or damper member 254. Damper member 254 may include an elastomeric damping element, or may be made of an elastomeric damping material. Damper member 254 may have the form of a cylinder of damping material, such as a circular cylindrical damper member shown in FIG. **6*d*, with a central bore for a fastener, counter-sunk at one end to accommodate passage of a mechanical fastener such as a bolt 260. The counter sink permits the bolt head to sit well shy of the end of the bore, and therefore distant from the opposing face of second member 252, such that they may tend not to contact each other in use. Second member 252 may define an opposed member, or a mating member against which, or in co-operation with which, first member 250 works. That is, in operation first member 250 and second member 252 may bear against each other, such that second member 252 may be said to define a seat which first member 250 may contact, and against which first member 250 may work. In one embodiment first member 250 may have the form of an elastomeric pad 256 and second member 252 may have the form of a plate, or stop, or deck reinforcement, or abutment 258 such as may oppose bumper pad 256 and may spread relatively evenly and transmit, and reaction force from or into deck 70 or 72, such as may discourage local damage thereto. Bumper pad 256 may have a central socket or depression, or relief or accommodation, or countersink 262, such as may accommodate the head of a fastener such as a bolt 260 by which, for example bumper pad 256 may be secured to panel 210 (or 208, or 206) of door 200 (or 202, as may be). In one embodiment first member 250 is mounted to door 200, and second member 252 may be mounted to deck 70 or 72, as may be. Alternatively, second member 252 may be mounted to door 200, and first member 250 may be mounted to deck 70 or 72**. To the extent that the decks of the rack structure may be defined as a stationary datum, or stator, for the purposes of vibration, the member mounted to the door, which is presumed to be the moving member in vibration, may also be termed the moving or dynamic member.

It may be that the engagement or co-operation of first member 250 and second member 252 may be one-way limiting. That is, in terms of the degree of freedom of displacement in the x-direction, mutual interaction of first member 250 with second member 252 may limit motion of panel 210 of door 200 in the +x direction toward deck 70 (or 72, as may be), but may not impede, inhibit, or obstruct motion of panel 210 of door 200 in the −x direction away from deck 70 (or 72).

In one embodiment, either or both of dynamic response members 240 and 242 may divide, or break-up, the vertical span of panel 210 into lesser fractions such as may tend to correspond to a higher mode, or higher frequency, of vibration in the lengthwise direction. Alternatively, or additionally, either or both of members 240, and 242 may serve to dampen such vibration as may occur.

In one embodiment, pad 256 may be mounted to door panel 210, and may have an axial adjustment member, be it a shim, or set of shims, or a threaded member such as a bolt 260, to permit adjustment in the x-direction. Equally, it may be the position of abutment 258 that may be adjusted by the use of shims or a threaded member. Such adjustment may be locked in place once set, e.g., with locknuts or wire. In either case, the axial i.e., x-direction, relationship of pad 256 and abutment 258 may be set such that as door 200 is closed, pad 256 is positioned just to touch the end face of abutment 258 with contact but zero pre-load. In another embodiment the relationship may be adjusted such that when door 200 is closed pad 256 is compressed either by a predetermined distance of compression, be it 1/16 or ⅛ of an inch or some other distance, such as within a clearance range of 0 inches, +0 to −⅛, or by a predetermined loading, be it 5 lb or 10 lb of pressure, or such pressure as may be.

Generally, there is a panel member that is large in its extent in the vertical direction, and also substantial in its extent in the lateral direction as compared with the panel thickness. The panel is hingedly attached to an adjacent panel of the door. The panel has first and second, spaced apart nodal points at which it is, in the closed position, secured, attached, or tethered, those two nodal or attachment locations being typically at the top and bottom ends of the panel next adjacent to the main deck floor and to the roof respectively. A third element is introduced intermediate the first and second nodal points or attachments to break up the span. In the embodiments shown in the illustrations and described above, that third, or intermediate, element may be a damper in the form of a bumper pad.

By adding dynamic response members, or bumpers, longitudinal inward motion in the door may be inhibited if not entirely stopped. This may help to interrupt the span of the vibrating member and may tend effectively to raise the natural frequency, such that the doors may be more resistant to motion and subsequent damage from vibration. Alternatively motion damping may tend to convert kinetic energy of mechanical motion to heat. This feature may make the tri-fold doors more resistant to vibration, and therefore less susceptible to vibration-induced fatigue damage. By being less susceptible to damage from vibration, operators may require less effort to maintain the doors.

Dynamic response members 240 and 242 are intended to be representative. A greater number of dynamic response elements could be incorporated. Bumpers may be added at one or more locations on the interior of door 200 (or 202) and on any of panels 206, 208 and 210, or at the decks or sides of the autorack. They could be made of any material, though softer ones like rubber would more effectively dissipate the vibrational energy.

As noted above, outboard door panel 206 may have an access or step assembly in the nature of a ladder 270. In one embodiment ladder 270 may have, or may be, a series of ladder rungs 272, mounted to door panel 206. When door 200 (or 202) is closed, rungs 272 are hidden, facing inwardly into the inside of car 20. When door 200 is open, and latched in the open position as shown in FIG. 4*b*, one may climb up rungs 272 to ascend any of the decks, as may be. Co-operating hand-hold rungs 268 are provided inside housing 28. Ladder 270 may include, at its lowermost end a footstep, or sill step, or lowermost foothold member or assembly, indicated as 280, described in greater detail below. It may be noted preliminarily that car 20 also has another step assembly, in the form of another ladder, or set of ladder rungs, 274 mounted in a fixed position on the outside wall of housing 28 near the "point", or corner, of car 20, with a lowermost foothold, or step 276 depending from the side sill. This ladder may be used by railroad personnel while operating the adjacent handbrake apparatus 278, also mounted to the outside of housing 28, longitudinally inboard of ladder rungs 274. It is not intended that ladder 270 be confused with ladder 274.

Figure 7C:
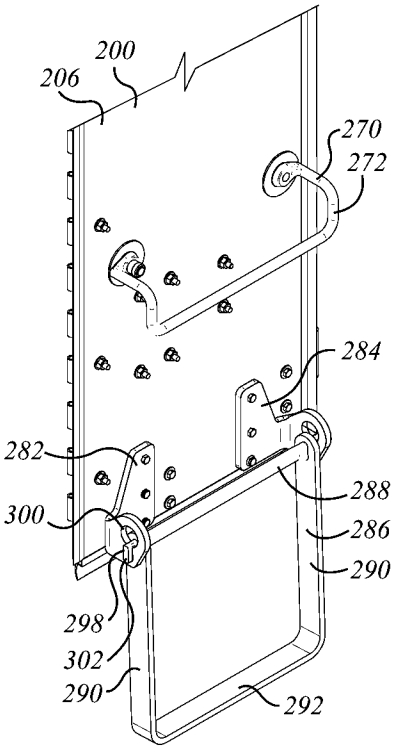
FIG. 7*c* is an isometric view of the movable step assembly of FIG. 7*a* in a deployed or extended position.
Figure 7B:
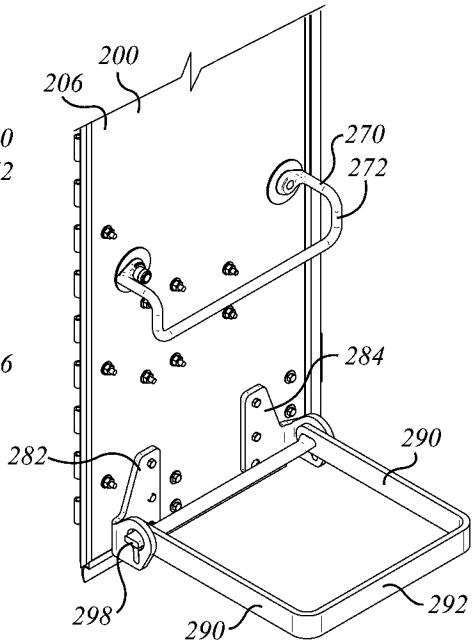
FIG. 7*b* is an isometric view of the movable step assembly of FIG. 7*a* in a transitional condition.
Figure 7A:
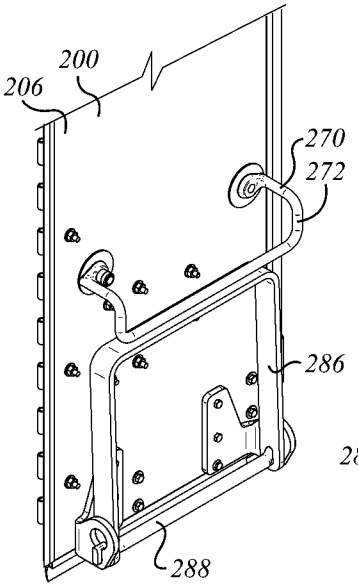
FIG. 7*a* is an isometric view of a movable step assembly in a refracted position.
Figure 8A:
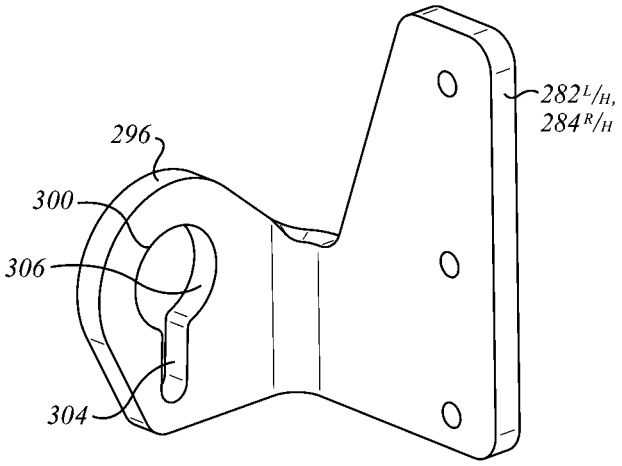
FIG. 8*a* is an isometric view of a bracket of the step assembly of FIG. 7*a;*
Figure 8B:
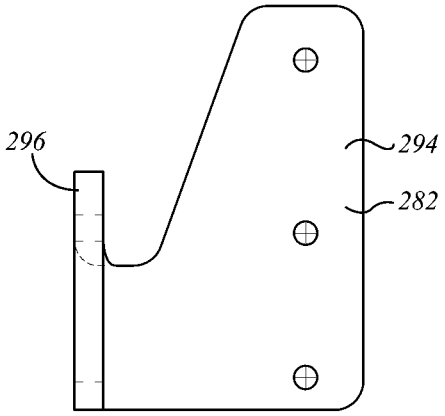
FIG. 8*b* is a front view of the bracket of FIG. 8*a*.
Figure 8C:
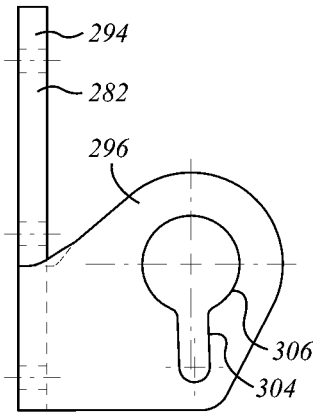
FIG. 8*c* is a side view of the bracket of FIG. 8*a*.

Lowermost foothold assembly 280 is a movable sill step, or foothold, as seen in the progression of views in FIGS. 7*a*, 7*b*, and 7*c*. In the embodiment shown foothold assembly 280 includes is a stationary portion (i.e., in fixed position relative to the door panel, be it 206) in the form of co-operative first and second mounting brackets, indicated as left hand bracket 282 and right hand bracket 284. These brackets are mounted in fixed position on door 200, and vary only in handedness. The foothold assembly, or step, or rung assembly 280 also includes a movable portion, which, in one embodiment has the form of a generally U-shaped step 286, and an axle or cross-piece 288. U-shaped step 286 has left and right hand arms 290, and a rung, 292. Cross-piece 288 also defines the first hand-rung (or second foot rung) of ladder 274. U-shaped step 286 is movable relative to door 200 between the refracted, transition, and deployed positions shown in the Figures. When brackets 282, 284 are installed, they form a yoke that captures cross-piece 288 (and thus all of the movable portion of assembly 280). The term "capture" means that although the movable portion can move, it is constrained throughout its entire operating envelope to stay mounted to the yoke. It cannot escape, i.e., come loose and fall off the car.

Each of brackets 282, 284 has a first portion in the nature of a base or foot or fitting 294 that mounts to door 200, such as to the inside face thereof, e.g., on panel 206; and an outwardly standing second portion, which may have the form of a wing or flange, or lug, or yoke end, or seat, 296. The movable portion of assembly 280 includes mating members that lodge in seats 296 of brackets 282, 284. It may be noted that cross-piece 288 has ends that are not round in section, but rather that have been flattened to rectangular tabs 298. Those tabs define mating members that have the form of "keys" or protrusions, or wings, which, in the embodiment illustrated may have a generally rectangular cross-section.

Seat 296 includes an indexing member or fitting in the form of an accommodation 300 that mates in co-operable inter-engagement with a mating indexing feature 302 of the movable portion of assembly 280, such as a respective one of tabs 298. Accommodation 300 may have the general form, or shape, of a keyhole, as illustrated. Accommodation 300 has a first portion 304 and a second portion 306. First portion 304, which may correspond to the leg of the keyhole shape, may define a pocket, or solid-bottomed slot, or hold, or seat, that permits a single degree-of-freedom of motion, in this instance vertical translation. Notably it does not permit a rotational degree of freedom about the horizontal axis of cross-piece 288. In the embodiment shown, as installed, second portion 306 is above first portion 304. Second portion 306 may have a generally round, circular shape such as to permit motion of the keys in a different degree of freedom, such as rotation of tabs 298, whereby the orientation of the moving portion of the assembly may be changed. The rectangular tabs 298 function as the indexing members, or keys, that are able to seat in first portion 304 in a limited number of distinct positions. In the embodiment shown there are two such positions, namely the first, or 12 o'clock, position shown in FIG. 7*a*, and the second, or 6 o'clock position shown in FIG. 7*c*. In this embodiment the positions shown are reversible, i.e., one is the inverse of the other. The effective angle of rotation of tabs 298 is 180 degrees. However, a key with legs angled as some angle other than 180 degrees could be formed, as might be appropriate. When in either position the movable portion of assembly 280 is constrained to sit in a predominantly upright or upwardly vertical or predominantly downwardly depending or downwardly vertical position, and is prevented from moving to an out-of-plane position or orientation, (as by rotation about the axis of cross-piece 288) by the engagement of the sides of the keys in the mating slot. Transition between the first and second positions requires un-seating tabs 298 from first portion 304 by lifting step 286, i.e., in the vertical translational degree-of-freedom. Once in second portion 306, step 286 is then swung in a different degree of freedom, e.g., rotation, either upward or downward as may be appropriate, to the other position. Finally, now-reversed tabs 298 are again introduced into first portion 304 by translation in the degree-of-freedom dictated by the direction of the slot, where step 286 is again inhibited from rotating or otherwise moving in the out-of-plane direction. In the upward, or stowed, or retracted or inoperative position shown in FIG. 7*a*, door 200 may be closed. In the deployed position of FIG. 7*c*, a person may climb ladder 270, but door 200 may not be closed. It may be noted that in the embodiment shown assembly 280 if free of springs. It is also free of loose parts that might be lost.

The position shown in FIG. 7*a* is a local equilibrium position. The position shown in FIG. 7*b* is a global equilibrium position. In each instance, potential energy must be added to the system to move it from an equilibrium position in the slot of first portion 304 to the transition position or condition of second portion 306. If the step is left in a non-equilibrium position, gravity will urge it to a local or global lowest potential energy state into one or other of the positions in which rotation is inhibited.

Accommodation 300 and mating indexing feature 302 are inter-engaging female and male parts. This relationship is to some extent arbitrary, since, a different configuration or embodiment could be made in which the accommodation is formed on the moving part, and the mating lug or key is formed on the stationary part.

Conventionally, door steps are mounted to the side of the car and fixed in place. The design of the car is such that a conventional door step mounted on the door would impede the door closure. The retractable step allows an operator to climb onto the car like a normal door step (when extended), but also allows the doors to be closed (when refracted). When in the stowed position, the step is tucked next adjacent to the door panel, at a height above, and clear of, the main deck such that the door may close. In the extended position the step depends below the height of the main deck, with the foot rung 292 being at a comparable level of height to that of depending step 276. As well, the movable door step described may tend to be relatively easy to manufacture and use, and may tend to be robust. The design is self-contained. The operator will only need to move the step from one position to the other.

The retractable door step as described allows for positive locking in both the operational position, and the stored position. The design also allows for the step to be moved from one position to the other without any additional parts, or parts that have to be retracted and replaced, such as a pin or key, that may otherwise be lost, or not re-positioned correctly. This is accomplished by the design of the first handhold on the step (included in door step assembly). This handhold interacts with brackets on the door that contain a key slot cut-out. By moving the door step, the handhold moves around in the key slot, and is able to lock in the operation position, or the stored position.

One known car requires a locking mechanism to hold the step in place when stored. The embodiment shown eliminates this part and consequently eliminates an operation that a worker will need to perform when using the car. This may tend to yield simplicity and ease of use of the door step for the operators. Reduction in use of extra parts may end to reduce maintenance. A known design uses a door step that slides vertically up or down. A catch lock at the top provides locking in the stored position. The embodiment shown eliminates the use of a catch lock, and instead uses a key slot and the door step weight, i.e., gravity, to provide the locking Various embodiments have been described in detail. Since changes in and or additions to the above-described examples may be made without departing from the nature, spirit or scope of the invention, the invention is not to be limited to those details.

I claim:

1. An autorack railroad car for rolling motion in a longitudinal direction along railroad tracks, said autorack railroad car comprising:

a main deck;

a first elevated deck spaced upwardly from said main deck;

a housing enclosing said main deck and said first elevated deck;

said housing including a roof spaced upwardly of said first elevated deck;

said housing having an access-way at a first end thereof through which to conduct wheeled vehicles onto said main deck and said first elevated deck;

a door movable to govern access to said housing;

said door being a folding door hingedly mounted to said housing, said door having at least a first panel and a second panel hingedly connected together;

said door having an upstanding first margin and an upstanding second edge margin;

when said door is in a closed position said upstanding second edge margin being laterally inboard of said upstanding first margin;

at least a first of said first and second panels of said door having a first vibration nodal point adjacent said main deck, and a second vibration nodal point distant from said main deck;

a dynamic response member positioned height-wise intermediate said first nodal point and said second nodal point, and laterally inboard of said upstanding first margin; and in said closed position of said door said dynamic response member impedes primary mode vibration of said door in the longitudinal direction.

2. The autorack railroad car of claim 1 wherein said first panel of said door extends to a nodal securement at said roof defining said second nodal point.

3. The autorack railroad car of claim 1 wherein said dynamic response member is positioned longitudinally between said first elevated deck and said door.

4. The autorack railroad car of claim 3 wherein said dynamic response member is mounted between said first elevated deck and said door with a clearance in the range of 0" to ⅛", and with no longitudinal pre-load of said dynamic response member.

5. The autorack railroad car of claim 3 wherein said dynamic response member has a first portion mounted to one of (a) said door, and (b) said first elevated deck; and a second portion mounted to the other of (a) said first elevated deck, and (b) said door; said first and second portions of said dynamic response member are mounted to work co-operably in opposition to each other; and said first portion includes a damping material and said second portion defines a seat positioned for engagement by said damping material.

6. The autorack railroad car of claim 1 wherein at least a first portion of said dynamic response member is mounted to said first elevated deck.

7. The autorack railroad car of claim 6 wherein a second portion of said dynamic response member is mounted to said door.

8. The autorack railroad car of claim 7 wherein said first and second portions of said dynamic response member interact.

9. The autorack railroad car of claim 1 wherein, when said door is closed, said dynamic response member is longitudinally pre-loaded in the longitudinal direction.

10. The autorack railroad car of claim 1 wherein said dynamic response member comprises a damper.

11. The autorack railroad car of claim 1 wherein said dynamic response member defines a vibration nodal point intermediate said main deck and said roof.

12. The autorack railroad car of claim 1 further comprising a second dynamic response member, said second dynamic response member being spaced height-wise from said first dynamic response member, and said second dynamic response member being located intermediate said first dynamic response member and said roof.

13. The autorack railroad car of claim 12 further comprising:

a second elevated deck spaced upwardly from said first elevated deck;

said roof being spaced upwardly of said second elevated deck;

said first dynamic response member being mounted to work between said door and said first elevated deck; and said second dynamic response member being mounted to work between said door and said second elevated deck.

14. The autorack railroad car of claim 13 wherein each of said first and second dynamic response members includes a damper.

15. The autorack railroad car of claim 1 wherein said door is a first door, said car has a mating second door, said first and second doors being co-operable to govern access to said first end of said housing.

16. The autorack railroad car of claim 1 wherein:

said dynamic response member is positioned longitudinally between said first elevated deck and said door;

at least a first portion of said dynamic response member is mounted to said first elevated deck;

a second portion of said dynamic response member is mounted to said door;

said first and second portions of said dynamic response member interact;

one of said first and second portions includes a damper;

when said door is closed, said first panel is laterally outboard of said second panel; and said dynamic response member is mounted to said second panel.

17. The autorack railroad car of claim 16 wherein said dynamic response member defines a vibration nodal point intermediate said main deck and said roof.

18. An autorack rail road car comprising:

a main deck;

a first elevated deck spaced upwardly from said main deck;

a housing enclosing said main deck and said first elevated deck;

said housing including a roof spaced upwardly of said first elevated deck;

said housing having an entryway at a first end thereof through which to conduct wheeled vehicles onto said main deck and said first elevated deck;

a door movable to govern access to said housing;

said door having at least first and second upstanding panels, said first panel standing upwardly next to said second panel and being hingedly connected thereto;

said door having an upstanding root margin and an upstanding free edge margin;

when said door is in a closed position said upstanding free-edge margin being laterally inboard of said upstanding root margin; and said door having an overall height, said overall height defining a span associated with a primary mode natural frequency of vibration; and when said door is in said closed position said door engages said first elevated deck, said engagement sub-dividing said span, whereby said door is inhibited from vibrating in said primary mode.

19. The autorack rail road car of claim 18 wherein said first panel has a first end and a second end, and, when said door is in said closed position, said first end of said first panel is secured adjacent to said roof, and said second end of said first panel is secured adjacent to said main deck.

* * * * *